US005620834A

United States Patent [19]

Green

[11] Patent Number: 5,620,834

[45] Date of Patent: Apr. 15, 1997

[54] METHOD OF PROCESSING PHOTOGRAPHIC SILVER HALIDE MATERIALS

[75] Inventor: Jeffrey K. Green, Harrow, England

[73] Assignee: Eastman Kodak Company, Rochester, N.Y.

[21] Appl. No.: 612,615

[22] Filed: Mar. 6, 1996

Related U.S. Application Data

[60] Provisional application No. 60/641,600, May 1, 1996.

[30] Foreign Application Priority Data

May 4, 1995 [GB] United Kingdom ..... 9509111

[51] Int. Cl.$^6$ ..... G03C 5/31

[52] U.S. Cl. ..... 430/398; 430/30; 430/400

[58] Field of Search ..... 430/30, 398, 400

[56] References Cited

U.S. PATENT DOCUMENTS 3,970,457 7/1976 Parsonage ..... 430/398

5,180,648 1/1993 Nakamura ..... 430/400

5,206,121 4/1993 Fujita et al. ..... 430/400

5,480,769 1/1996 Ueffinger et al. ..... 430/400

*Primary Examiner*—Hoa Van Le

*Attorney, Agent, or Firm*—J. Lanny Tucker

[57] ABSTRACT

Black-and-white silver halide photographic materials are processed with the use of a processor which requires no silver recovery means, no water supply and no drain. The photographic material is transported through a series of processing tanks including a developer tank, one or more fixer tanks, and one or more wash or stabilizer tanks. Replenishment of the fixing solution is controlled so that the rate of replenishment of the fixer tank is a function of the level of one or more chemicals in the last tank through which the material is transported.

8 Claims, 2 Drawing Sheets

Fig 1 - Fixer Repenishment Rates
Total fixer rep rate (ml/sq.m)
180
160
140
100
80
60
40
20
0
0
0.5
1
1.5
2
2.5
3
3.5
Fixable silver (g/sq m)
Two Part Algorithm
Linear Algorithm

METHOD OF PROCESSING PHOTOGRAPHIC SILVER HALIDE MATERIALS

CROSS REFERENCE TO RELATED APPLICATION

Reference is made to priority claimed from U.S. Provisional application Ser. No. 08/641,600, filed May 1, 1996, entitled.

FIELD OF THE INVENTION

This invention relates in general to a method of processing photographic silver halide materials and in particular to such a method in which replenishment of the fixer solution is controlled to achieve significant savings in fixer.

BACKGROUND OF THE INVENTION

For environmental reasons, in recent years, there has been an increasing trend to reduce the amount of all chemicals, including water, used in photographic processing. Fixing photographic materials is necessary to remove any undeveloped silver halide after development which would otherwise slowly print-out and become indistinguishable from the image. In addition to this primary function, fixers are traditionally required to perform a number of other roles. These include, stopping photographic development and playing a part in washing out or decolorizing some film or process components. In order to accomplish the first of these, fixers are made sufficiently acidic to rapidly quench the development reactions within the film being processed. Most of the other secondary functions of fixers are achieved by components of the fixer not specifically included for that purpose.

In the graphic arts industry, very high contrast black-and-white materials are used. Ideal graphic arts images are formed with areas of maximum density (black) and minimum density (clear for film and white for paper) only. Traditionally, the major requirement for the washing section of a processor has been to maintain low levels of retained fixing agent (e.g. ammonium thiosulfate) in the processed film. This has usually been achieved by using very high wash replenishment rates typically between 2 and 10 liters of water per square meter of film processed. Retained non-image silver has not usually been considered a major cause of image deterioration since fixer replenishment rates have also been high. Also graphic arts processors have sometimes been equipped with silver recovery systems which remove silver from the fixing solution and so maintain low silver levels, typically around 2 grams per liter of fixer. With such low silver levels in the fixing bath and with large dilutions of silver carried into the wash section made possible by the high wash replenishment rates, the control of retained non-image silver has not been a problem. However, with the recent trend to use less wash water and fixer, and if for any reason (for example, cost, convenience, or potential hazards) a fixer silver recovery unit is not considered desirable, the levels of silver in the wash baths will rise.

U.S. Pat. No. 3,828,172 (Schickler) describes a method and apparatus for controlling the replenishment rate of chemicals expended during processing of photographic materials whereby the replenishment rate is linked to a calculated image silver signal.

European patent 0,456,684 (Rider) describes a method of controlling the rate of replenishment of chemical solutions used in photographic processing wherein a signal related to the measured exposure given to the photographic material is used to control the replenishment rate.

Soluble complexes of silver with fixing agent are by-products from the fixing reaction. These complexes are produced in the photographic material as the fixing agent reacts with undeveloped silver in the form of silver halide. The complexes diffuse out of the material and into the bulk of the fixing solution. Without silver recovery on the fixing bath, the concentration of complexed silver may build up to quite high levels, especially when low replenishment rates are used for the fixer and when the level of silver in the photosensitive material is high. Since fixing rate shows an inverse dependence on silver concentration in the fixer bath, the time required to clear the film will also depend on the silver level. Whilst silver recovery is therefore beneficial for the performance of the fixer bath, it represents significant extra capital cost. I have now found that it is not absolutely necessary.

It is useful to distinguish between two types of chemical species found in seasoned photographic solutions. There are those whose concentrations are largely independent of average exposure given to the photographic material being processed. These may be referred to as "image-independent" species. The independence arises because either a relatively small percentage of the total amount contained within the solution is used by an image dependant mechanism (eg thiosulfate) or because the reactions responsible for consuming these species are not primarily concerned with an image dependant mechanism (eg a pH buffer or antioxidant). For graphic arts black-and-white materials an example of an image-dependent chemical is silver (as silver complexes).

A particular problem for graphic arts films is a rise in the optical density in the ultra-violet region of the spectrum of the non-image areas, referred to as "UV Dmin" upon ageing of processed film. Frequently, ultra-violet contact exposures are used to copy a graphic arts film onto a printing plate or another piece of film and very high contrast images are needed for accurate copying. If, due to ageing, the difference between the minimum and maximum optical density of the image to be copied is reduced, the contrast of the image is effectively lowered. When the image is copied, inaccuracies may result. Furthermore, if the minimum density of the image increases, the overall exposure time for the copying process increases. For other types of silver halide images, whether black-and-white or color, changes in the tone scale and contrast of the image upon ageing are also detrimental even if no further copying process is involved because the quality of the image is reduced.

It has been determined experimentally that the action of non-image retained silver is very significantly worse for image degradation, and in particular for UV Dmin increase, than that of an equal weight of retained fixing agent. Normally, silver complexes are present in the fixer and wash solutions at significantly lower concentrations than the fixing agent. In certain circumstances however, especially in processors without silver recovery, the control of residual silver in the processed film may become more important than the control of residual fixing agent in determining wash water requirements.

PROBLEM TO BE SOLVED BY THE INVENTION

Whereas the concentration of thiosulfate ion in a seasoned fixer bath remains relatively constant despite changes in the average exposure given to the film being processed, silver levels vary greatly when there is no form of silver recovery used on the fixer. Current practice is to use a replenishment rate for the fixer and possibly silver recovery so that the levels of all the residual chemicals in the film leaving the fixer bath may easily be removed by clean water. However, there is currently increasing pressure on users of graphic arts processors to reduce their consumption of, and in particular their disposal of, all chemicals used in their processes including wash water and fixer.

SUMMARY OF THE INVENTION

The present invention provides a method of controlling the replenishment of fixer solutions in a black-and-white photographic silver halide material processing machine without any silver recovery means and requiring no water supply or drain, and which transports the material to be processed though a number of processing tanks including a developer tank, one or more fixer tanks and one or more wash or stabilizer tanks wherein the rate of replenishment of the fixer tank is a function of the level of one or more chemicals in the last tank though which the material is transported, said chemical(s) being those which affect the stability of the processed photographic material or those whose concentrations are related thereto.

ADVANTAGEOUS EFFECT OF THE INVENTION

Significant savings in fixer can be achieved without requiring the additional capital expense of silver recovery. Using the concentration of a chemical in the final tank gives a good indication of the level of that chemical in the fully processed material.

DETAILED DESCRIPTION OF THE INVENTION

The processor will typically have a developer tank, a fixer tank and one or more wash or stabilizer tanks and the photographic material will be transported through them in that order.

Figure 2:
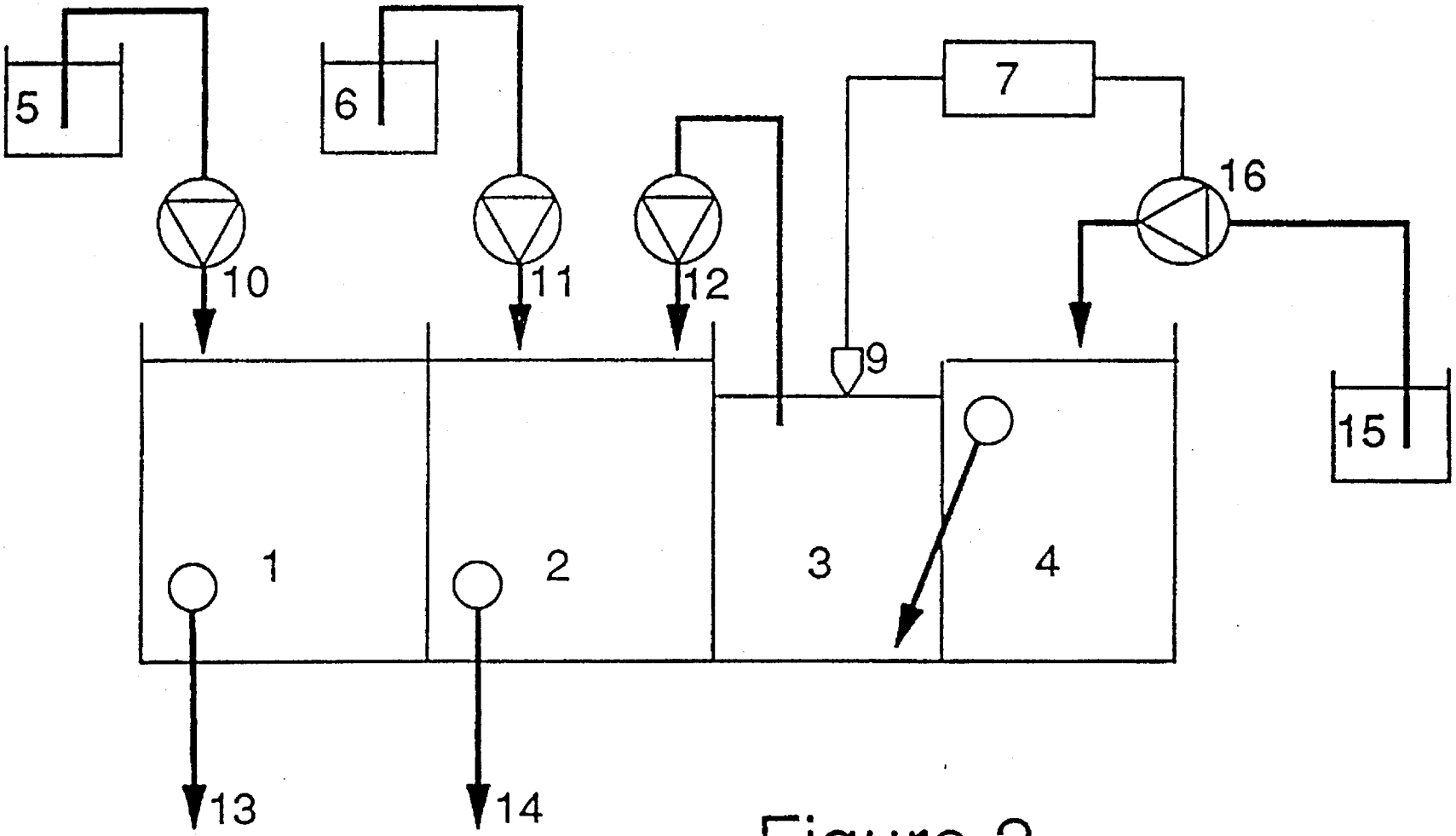
FIG. 2 is a schematic illustration of processing apparatus that can be used in the present invention.

FIG. 2 of the accompanying drawings shows a processing machine that can be used in a preferred embodiment of the present invention. The processor includes a developer tank (1), a fixer tank (2) and two wash tanks (3 & 4). The developer tank (1) is replenished from a holding tank (5) of previously mixed working strength developer replenisher, which is pumped into the developer tank at an appropriate rate by means of pump (10). The fixer tank (2) is replenished by means of pump (11), passing fixer concentrate from the holding vessel (6) and pump (12) passing wash water from wash tank (3) into the fixer tank (2) at an appropriate rate. The rates of replenishment of the solutions supplied by pumps (11) and (12) are maintained in a predetermined ratio. Wash tanks (3) and (4) are arranged such that when fresh wash solution is pumped from holding tank (15) by pump (16) into wash tank (4), the overflow so produced passes into wash tank (3), forming a conventional counter-flow wash section. Level sensor, (9) detects when the level of wash solution in wash tank (3) drops below a certain predetermined level. When the level drops below this predetermined level, a signal produced by the level sensor control means (7) sends a signal to pump (16) to add fresh wash solution to wash tank (4). When the level in wash tank (3) has increased above a certain predetermined level due to the overflow from wash tank (4), the level sensor control means ends the flow of fresh wash solution into wash tank (4). Extra level sensors (not shown) may also be provided so that evaporation losses may be controlled and appropriate extra solution replenishment may be made in any of the tanks.

The chemical in the final tank may, for example, be halide or, preferably, silver ions. As indicated above such ions are image-dependant.

It is preferred that the fixer replenishment rate has a minimum rate which is a rate sufficient to maintain the desired levels of image-independent chemicals.

An example of non-image-dependant functions is the stopping of development by reducing the pH. The minimum fixer replenishment rate must therefore be set so that the acidity of the fixer is always sufficient to prevent "dichroic fogging" caused by physical development of complexed silver ion. For example, minimum rate of fixer replenishment ($F_{min}$) may be defined for a particular processor and film type as the minimum fixer replenishment rate needed to maintain non-image-dependant fixer performance. Hence it is preferred that the rate of fixer replenishment has a minimum value below which it is not allowed to fall.

This minimum will be sufficient to maintain the concentration image-independent chemicals in the fixer bath at their required level. The maximum level of each residual chemical that can be tolerated in processed material must be determined as well as the concentration of this chemical in the final wash bath that will allow this level to be achieved. These values may be different for different materials and the ratio between them will depend to some extent on processor design. These values can be determined by subjecting photographic materials with varying contaminations to heat and UV light and measuring any change in $D_{min}$ and $D_{min}$(UV).

The threshold level of silver concentration is set by knowing the maximum changes in the image characteristics which would remain acceptable to users and then determining, by means of keeping tests, what level of residual chemicals will produce these maximum changes. For example, many users require that the minimum UV density of the film should not increase above 0.1. It has been determined using ANSI Standard simulated 10 year keeping tests that if the residual silver is kept below 20 mg/m$^2$ and the residual thiosulfate is kept below 200 mg/m$^2$, the UV Dmin will not exceed 0.1 after 10 years of ageing. It has been experimentally determined that for a typical graphic arts imagesetting film and processor, the level of silver in the final wash tank should be kept below 1 g/l to keep the residual silver in the processed film below 20 mg/m$^2$. For the processor in the example below, it has been determined experimentally that with a fixing time of 24 seconds and a total wash time of 28 seconds from entering the first wash bath to entering the dryer, this would require a fixer replenishment rate of around 190 ml/m$^2$ to cope with the worst-case final wash tank silver level arising from the processing of unexposed film with a coated silver weight of 3.3 g/m$^2$ and a wash replenishment of ⅔ of the total fixer replenishment rate (required for a fixer concentrate diluted to 1+2 for working strength in this example). If, however, the film was only 10% exposed, further experimental testing has confirmed that the fixer replenishment rate would only need to be around 120 ml/m$^2$. Considerable savings in fixer and wash water are thus made if the fixer replenishment rate is varied according to the level of chemicals in the final wash bath rather than assuming the worst case position, as is the current widely adopted practice.

The silver level in the final tank may be determined by measuring it directly with a sensor. Sensor technology is well understood and numerous electrodes are known which can be used to determine silver levels in solutions.

Alternatively it can be determined by calculation, based on a knowledge of the exposure given to the film being processed and the coated weight of silver in the film, or based on a measurement of the exposed area after development and a knowledge of the coated weight of silver in the film. The density of the exposed area may be also be calculated from the density of the processed film integrated over a predetermined period.

This level of silver will be instrumental in determining the amount of fixed or fixable silver that will be carried forward into the wash or stabilizer tank(s). Other factors influencing this carry forward and hence the contamination of the wash bath include the film structure and the agitation levels in the processor tanks. Where these factors are known or their combined effects can be measured, fixer replenishment rates may be set to the lowest appropriate level for a given level of washing based on the actual amount of silver in the final wash bath, rather than selecting the highest fixer replenishment rate to cope with the worst case. This enables significant savings in the usage of both fixer and wash water.

The present invention preferably controls the fixer replenishment rate using an algorithm so that levels of all residual chemicals in the final wash bath remain below their maximum permitted values and fixer performance is not impaired. The algorithm relates fixer replenishment rate to an image-dependent chemical concentration, such as for example, silver, in either a fixing bath or a wash bath.

For each chemical whose residual level must be controlled, there will be a maximum permitted figure for its residual level in the processed film such that when all residual chemicals are at their maximum levels, the processed photographic material will just meet the user's specification for image-stability upon ageing.

Once the maximum residual value for a particular chemical species is known, it is possible to calculate the maximum permitted concentration of this chemical species in the last wash bath of a processor with n wash baths.

It will be evident that the concentrations of image-dependent chemicals in the wash will be linked stoichiometrically. Thus, the halide ion molar concentration in the wash bath will be approximately the same as the silver molar concentration since the ratio of silver to halide ions in a photographic emulsion is 1:1. Any slight differences in molar concentrations in the fixer bath will be due to differences in diffusion rates of the species through gelatin, but these differences will be small.

The silver concentration in the final wash bath of a graphic arts processor may vary typically from as little as 0.04 g/l to as much as 2 g/l depending on the silver content of the photographic material being processed, the average exposure given to it and the replenishment rates. It has been experimentally determined that for a typical graphic arts imagesetting film and processor, the level of silver in the final wash tank should be kept below 1 g/l to keep the residual silver in the processed film below 20 mg/m$^2$. For the processor in the example above, it has been determined experimentally that with a fixing time of 24 seconds and a total wash time of 28 seconds from entering the first wash bath to entering the dryer, this would require a fixer replenishment rate of around 190 ml/m$^2$ to cope with the worst-case final wash tank silver level arising from the processing of unexposed film with a coated silver weight of 3.3 g/m$^2$ and a wash replenishment of two thirds of the total fixer replenishment rate (required for a fixer concentrate diluted to 1+2 for working strength). If, however, the film was only 10% exposed, further experimental testing has confirmed that the fixer replenishment rate would only need to be around 120 ml/m$^2$. Considerable savings in fixer and wash water can thus be made if the fixer replenishment rate is varied according to the level of chemicals in the final bath which degrade the image upon keeping, rather than remaining at the replenishment needed to cope with the worst case position, as is the current widely adopted practice.

As is normal, the processor is preferably controlled by a microprocessor which, by using an appropriate algorithm, can initiate fixer replenishment when needed.

In the case of a processor with 1 Developer, 1 Fixer and 2 wash tanks where the developer contains no silver (actually a small but unimportant level) and where water is replenished by adding water to wash 2 which overflows into wash 1 and thence to the fixer tank together with half that amount of fixer concentrate the following formulae can be used for the silver concentrations in each of the fixer and wash tanks at steady state.

The following expressions show how silver levels in the various tanks can be calculated:

| | |
|---|---|
| Silver in Fixer tank = | (Unexposed Area*Coated Silver*fixer efficiency + 2/3 wash1 concentration * Rep rate)/(Rep rate + Dev Carry in) |
| Silver in Wash Tank 1 = | (Unexposed Area*Coated Silver*(1-fixer efficiency) * wash efficiency + wash2 concentration *2/3* Rep rate + Fixer Carry out*Fixer Concentration)/(2/3 * Rep rate + Fixer Carry out) |
| Silver in Wash Tank 2 = | (Unexposed Area*Coated Silver*(1-fixer efficiency) * (1-wash1 efficiency) * wash2 efficiency + wash1 carry out*wash1 concentration)/(2/3 * Rep rate + wash1 Carry in) |
| Silver Residual on Film = | (Unexposed Area*Coated Silver*(1-fixer efficiency) * (1-wash1 efficiency) * (1-wash2 efficiency) + wash2 carry out*wash2 concentration |

Note it is assumed that although the fixer may not be 100% efficient at removing the silver it will have converted all undeveloped silver halide to a soluble form.

The above expressions can be solved iteratively to give an expression for fixer replenishment. This amount is then modified by adding the predetermined minimum rate of addition to replace losses of non image-dependant species.

Figure 1:
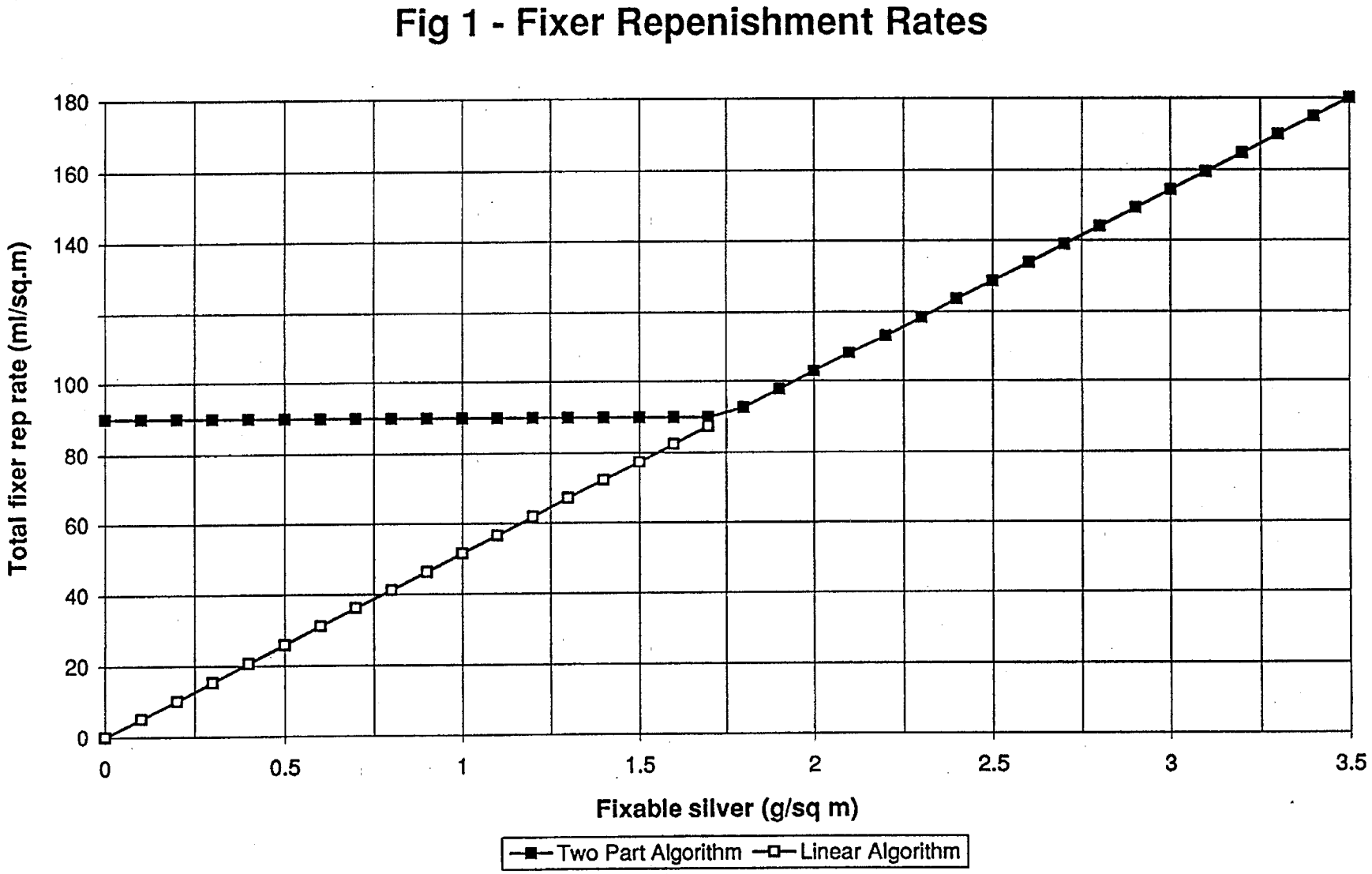
FIG. 1 is a plot of total fixer replenishment rate in milliliters per square meter versus fixable silver in grams per square meter.

FIG. 1 of the accompanying drawings shows such a result for a typical film and set of processing solution and machine variables. The linear algorithm represents the calculated replenishment rate while the two part algorithm uses a minimum rate which is sufficient to replenish the image-independant chemicals.

The following Example is included for a better understanding of the invention.

EXAMPLE

This example relates to the processing of graphic arts imagesetting films for laser exposure in a processor with no silver recovery on the fixer bath or elsewhere. The machine used is as described in FIG. 2.

The films are processed in the following sequence:

| | |
|---|---|
| Develop | 24s @ 35° C. |
| Fix | 24s @ 35° C. |
| Wash | 28s total at 23° C. |

The wash was carried out in two tanks the last of which is replenished with water with the overflow flowing into the first tank.

The developer had the formulation:

| | |
|---|---|
| Potassium hydroxide | 21 g/l |
| Sodium metabisulfite | 49.5 g/l |
| Sodium bromide | 3.8 g/l |
| Sodium hydroxide | 6 g/l |
| Benzotriazole | 0.21 g/l |
| Phenylmercaptotetrazole | 0.013 g/l |
| Hydroxymethyl-methyl-phenidone | 0.8 g/l |
| Hydroquinone | 25 g/l |
| Potassium carbonate | 36.3 g/l |
| pH | 10.40 |

and the fixer concentrate (diluted 1:2 parts with water for the working strength) had the following formulation:

| | |
|---|---|
| Acetic Acid | 30 g/l |
| Ammonium Acetate | 68 g/l |
| Ammonium Thiosulfate | 500 g/l |
| Ammonium Sulfite | 40 g/l |
| Water - demineralised to pH = 5.5 | 1 liter |

In this example, fixer and wash replenishment rates are linked because outflow from the wash bath nearest the fixer bath is used in total to dilute fixer concentrate. The algorithm chosen maintains a constant ratio of 2:1 between wash and fixer replenishment rates. Buffering requirements of the fixer dictate a minimum fixer concentrate replenishment rate of 37.5 ml/m$^2$ (and therefore wash replenishment of 75 ml/m$^2$). To maintain the final wash tank below the maximum permitted level of silver, the total fixer replenishment rate is increased linearly from a notional minimum to a maximum of 67.5 ml/m$^2$ of fixer concentrate and (125 ml/m$^2$ of water) when none of the silver halide in the film has been developed. The algorithm selects the larger of the numbers produced from these two considerations. Further refinements are possible. The current standard replenishment rate for a system without silver recovery is about 350 ml/m$^2$.

As an alternative to replenishing the fixer with a 2:1 mixture of wash water outflow and fixer concentrate, water from the public supply may be used instead of the outflow.

The invention has been described in detail, with particular reference to certain preferred embodiments thereof, but it should be understood that variations and modifications can be effected within the spirit and scope of the invention.

I claim:

1. A method of controlling the replenishment of fixer solutions in a black-and-white photographic silver halide material processing machine without any silver recovery means and requiring no water supply or drain, and which transports the material to be processed though a number of processing tanks including a developer tank, one or more fixer tanks and one or more wash or stabilizer tanks wherein the rate of replenishment of the fixer tank is a function of the level of one or more chemicals in the last tank though which the material is transported, said chemical(s) being those which affect the stability of the processed photographic material or those whose concentrations are related thereto.

2. A method as claimed in claim 1 in which the chemical is silver or halide ions.

3. A method as claimed in claim 1 in which fixer replenishment is initiated when the silver level of the final wash tank rises above 1 g/l.

4. A method as claimed in claim 1 in which the silver level in said last tank is calculated based on a measure of the amount of silver produced on development.

5. A method as claimed in claim 4 in which the silver level is calculated as a function of the level of silver in the unexposed photographic material and the average or integrated level of exposure given over a predetermined period.

6. A method as claimed in claim 1 in which the fixer replenishment does not drop below a predetermined minimum level.

7. A method as claimed in claim 6 in which the minimum level is sufficient to maintain the concentration of one or more non image-dependant chemical species.

8. A method as claimed in claim 7 in which the minimum level of replenishment is sufficient to maintain the desired pH of the fixer.

* * * * *

UNITED STATES PATENT AND TRADEMARK OFFICE

CERTIFICATE OF CORRECTION

PATENT NO. : 5,620,834

DATED : April 14, 1997

INVENTOR(S) : Jeffrey K. Green

It is certified that error appears in the above-indentified patent and that said Letters Patent is hereby corrected as shown below:

Title page - delete --[60] Provisional application NO. 60/641,600, May 1, 1996.--

Signed and Sealed this

Eighth Day of July, 1997

Bruce Lehman

*Attest:*

BRUCE LEHMAN

*Attesting Officer*

*Commissioner of Patents and Trademarks*